US005337035A

United States Patent [19]

Idei et al.

[11] Patent Number: 5,337,035

[45] Date of Patent: Aug. 9, 1994

[54] DISCHARGE TUBE

[75] Inventors: Gijun Idei; Takuji Kinoshita; Kunio Hoshino, all of Shizuoka, Japan

[73] Assignee: Yazaki Corporation, Tokyo, Japan

[21] Appl. No.: 51,669

[22] Filed: Apr. 26, 1993

[30] Foreign Application Priority Data

Apr. 27, 1992 [JP] Japan ..... 4-107661

[51] Int. Cl.[5] ..... H01H 61/00

[52] U.S. Cl. ..... 337/28; 337/34; 361/120

[58] Field of Search ..... 361/120, 112, 56, 118; 337/28, 34

[56] References Cited

U.S. PATENT DOCUMENTS 4,433,354 2/1984 Lange et al. ..... 361/120

5,142,434 8/1992 Boy et al. ..... 361/120

*Primary Examiner*—Lincoln Donovan

*Attorney, Agent, or Firm*—Nikaido, Marmelstein, Murray & Oram

[57] ABSTRACT

The discharge tube of this invention does not employ special shapes of electrodes that are difficult to manufacture, but can still provide a uniform electric field. The electrodes are disposed in the inwardly drawn portions of the cylindrical body in such a way that the opposing front end surfaces of the electrodes are recessed from the inner surfaces of the inwardly drawn portions in a direction that they move away from each other. The discharge electrodes therefore do not project into the inner space of the cylindrical body but are enclosed by the inwardly drawn portions so that they are protected against influences of external electric fields from outside the discharge tube, thus assuring stable and reliable discharges.

8 Claims, 5 Drawing Sheets

DISCHARGE TUBE

BACKGROUND OF THE INVENTION

1. Field of the Invention

The present invention relates to a discharge tube and more particularly to a discharge tube suitable for stabilizing discharges.

2. Description of the Prior Art

Discharge tubes—in which a discharge gas is sealed into an insulating tube and a voltage is applied between electrodes fitted at the ends of the insulating tube to produce a discharge in the sealed gas—have been in wide use in many fields.

FIG. 4 shows one such conventional discharge tube 1. It has an insulating tube 2 which is a hollow cylindrical member made of such materials as alumina ceramics and drawn inwardly at both ends. The insulating tube 2 is formed by joining a body portion 2*a* and a cover portion 2*b* with a glass frit 3. In openings 4 formed at the drawn portions at the ends of the insulating tube 2 are installed a pair of electrodes 5, which are formed by press-forming a perforated thin metal plate into a shape of Rogoski electrode or Harrison electrode that produces a uniform electric field. A base flange portion 5′ of each electrode 5 is engaged with the peripheral portion 4′ of the opening 4.

Cover-shaped electrode bases 6 made of conductive metal plates are placed on the ends of the insulating tube 2 from outside to cover the openings 4 at which the electrodes 5 are installed. The electrode base 6 clamps between it and the peripheral portion 4′ of the opening in the insulating plate 2 the base flange portion 5′ of each electrode 5. The end surfaces 6′ of the electrode bases 6 are fused by soldering to metalized surfaces 7 formed at the end surfaces of the insulating tube 2 so that the electrodes 5 are securely held by the electrode bases 6, while at the same time sealing the openings 4 where the electrodes 5 are installed.

One of the electrode bases 6 is provided with a supply pipe 8 to supply and seal a discharge gas such as argon under high pressure into the insulating tube 2. The supply pipe 8 is sealed after the discharge gas is introduced.

In such a discharge tube 1, a specified voltage is applied between the electrode bases 6 to generate a uniform electric field in a discharge gap G between the tips of the opposing electrodes 5. A stable discharge occurs in the discharge gap G.

The drawn portions at the ends of the insulating tube 2 elongates the distance along the inner wall surface of the insulating tube 2 from one electrode 5 to the other. This contributes to preventing flashovers along the inner surface of the tube, ensuring that a discharge occurs at a sufficiently high discharge starting voltage in the discharge gap G.

In the above-mentioned conventional discharge tube i however, since the electrodes 5 as a whole project into the inner space of the insulating tube 2 in which a discharge gas is sealed, any conductor with a specified potential, if located near the discharge tube 1, will greatly influence the tube by the electric field of the conductor. This may result in large variations of the discharge starting voltage. That is, stable discharge cannot be obtained due to influences outside the discharge tube.

Because the electrodes 5 are made in the form of Rogoski and Harrison electrodes which are designed to produce a uniform electric field, a precision machining technique is required for machining the surface of the electrodes, making the manufacture very difficult and increasing the cost.

FIG. 5 shows the cross sections of the uniform field generating electrodes of various types. As shown in the figure, although the diameter varies depending on the discharge gap G, a 120° Rogoski electrode must have a diameter about 10 times the discharge gap G and a 90° Rogoski electrode is required to have a diameter about 6.5 times the discharge gap G. Even with the Harrison electrode said to be most suited for generating uniform fields, the electrode diameter necessary is about 5.6 times the discharge gap G. The diameter of the discharge tube 1 as a whole therefore will become excessively large. Conversely, with electrodes with limited diameters, it is only possible to provide a discharge gap G about 1/10 to 1/5.6 the diameter, so, that to obtain a desired discharge starting voltage requires sealing a discharge gas under extremely high pressure. Such electrodes require very precise machining of their contours and even a slight error in contour curvature will result in an uneven field, producing high field intensity areas. This in turn produces localized discharges, making the discharge unstable.

The above discharge tube 1 uses such bonding agents as glass frit 3 to join the body portion 2*a* and the cover portion 2*b* to form the insulating tube 2 whose end portions are drawn inwardly. The openings 4 in the body portion 2*a* and the cover portion 2*b* where the electrodes 5 are installed are sealed with the electrode bases 6 that are fused to the drawn portion of the insulating tube 2. Because of this construction, the pressure of the high-pressure discharge gas sealed in the insulating tube 2 acts on the electrode bases 6, which seal the openings 4, and also on the cover portion 2*b*. If the bonding force between the body portion 2*a* and the cover portion 2*b* is not large enough to resist this pressure, the bonded portion may break leaking the gas. In that case a desired discharge characteristic is not obtained.

SUMMARY OF THE INVENTION

The present invention has been accomplished with a view to overcoming the above drawbacks and its objective is to provide a reliable discharge tube, which can provide stable discharges without having to form electrodes into such shapes as are difficult to manufacture and which has no possibility of gas leakage.

To achieve the above objective, the discharge tube of this invention comprises: a cylindrical body made of an insulating material in which a discharge gas is sealed, the cylindrical body having a body portion and an inwardly drawn portion, the inwardly drawn portion being inwardly drawn from at least one of the ends of the body portion; and a pair of opposing discharge electrodes located inside and at both ends of the cylindrical body, one of the discharge electrodes being disposed inside the inwardly drawn portion so that the one discharge electrode is enclosed by the inwardly drawn portion and that the front end portion of the one discharge electrode is recessed from the inner end surface of the inwardly drawn portion, which faces the other discharge electrode, in a direction that it moves away from the other electrode.

The discharge tube is also characterized in that the body portion of the cylindrical body is provided with a first conductive layer, the outer surface of the inwardly drawn portion is provided with a second conductive layer, which is electrically connected with the first conductive layer, and the first and the second conductive layers are applied with a potential of the one discharge electrode.

The discharge tube is further characterized in that the cylindrical body is formed of a body portion and a cover portion, the cover portion is formed as the inwardly drawn portion, the body portion is provided with a first conductive layer, the outer surface of the cover portion is provided with a second conductive layer, a joint surface of the cover portion with respect to the body portion is provided with a third conductive layer electrically connected with the second conductive layer, the first and the third conductive layers are fused together, and each of these conductive layers is applied with a potential of the one discharge electrode.

Further the discharge tube according to this invention comprises: a cylindrical body made of an insulating material in which a discharge gas is sealed, the cylindrical body having a body portion and a cover portion joined together, the cylindrical body having the end portions thereof drawn inwardly; a pair of opposing discharge electrodes located inside the inwardly drawn portions; first opposing conductive layers provided to the body portion of the cylindrical body; and second opposing conductive layers provided to the outer surfaces of the inwardly drawn portions of the cylindrical body, the second conductive layers being electrically connected with the first conductive layers; whereby the first conductive layers and the second conductive layers are applied with potentials of the corresponding discharge electrodes, respectively, and at least one of the first conductive layers on that side of the body portion where the cover portion is joined is fused with one of the discharge electrodes located on the cover portion side.

With this invention, in the inwardly drawn portions of the cylindrical body the discharge electrodes are installed so that the front ends of the discharge electrodes are recessed from the inner surfaces of the drawn portions—which face the other discharge electrodes—in a direction that they move away from each other, the discharge electrodes do not project into the internal space of the cylindrical body but stay enclosed by the inwardly drawn portions. This construction prevents the discharge electrodes from being affected by external electric fields from outside the discharge tube, assuring stable discharges.

The electric field generated in the inwardly drawn portions of the cylindrical body so disposed as to enclose the discharge electrodes and the electric field generated in the body portion of the cylindrical body by the potentials applied to the discharge electrodes cooperate with each other to produce an electric field near the front ends of the electrodes. The electric field thus obtained near the front ends of the discharge electrodes is more uniform than it is when the electrodes are not enclosed by the inwardly drawn portions. Therefore, the discharges are stabilized.

Further, the inwardly drawn portions of the cylindrical body are formed by the cover portion; the body portion is provided with the first conductive layers; the outer surface of the cover portion is provided with the second conductive layer; the joint surface of the cover portion joined to the body portion is provided with the third conductive layer; and the first and third conductive layers are soldered together to firmly join the body portion and the cover portion. This construction prevents gas leakage, enhancing the reliability of the discharge tube.

Furthermore, on that side of the cylindrical body where the cover portion is joined to the body portion, the discharge electrode is not soldered to the cover portion but to the body portion, so that a high gas pressure that acts on the discharge electrode which seals the opening does not act directly on the cover portion, preventing a possible break of the joint between the body portion and the cover portion due to high gas pressure. The discharge tube therefore has no possibility of gas leakage and offers high reliability and performance.

DETAILED DESCRIPTION OF PREFERRED EMBODIMENT

Embodiments of the present invention will be described by referring to FIGS. 1 to 3.

Figure 1:
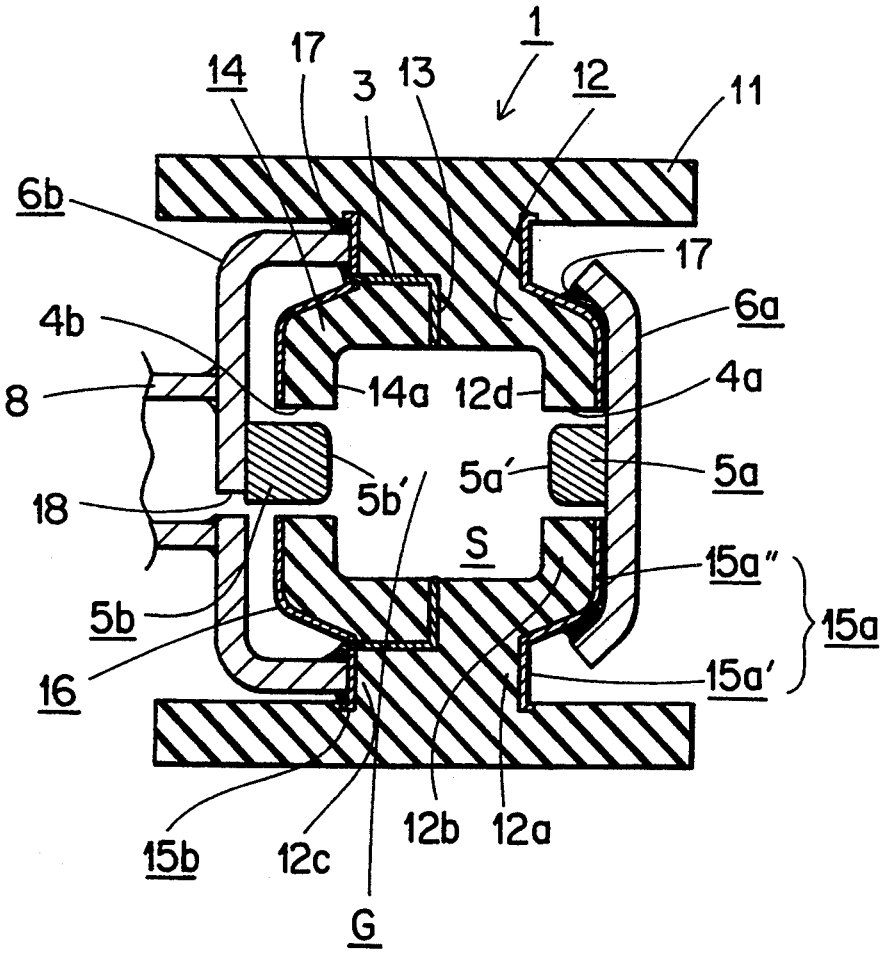
FIG. 1 is a cross section of a first embodiment of the discharge tube according to this invention.

FIG. 1 shows a cross section of a first embodiment of the discharge tube i according to this invention. The discharge tube 1 consists of a cylindrical body 11 made of an insulating material such as alumina ceramics. The inner surface of the cylindrical body 11 is drawn inwardly to form a partition wall 12, which is bulged toward one side of the cylindrical body 11. On the other side of the partition wall 12 is formed a notched portion 13, to which a cover 14, separate from the partition wall 12 and made of a similar insulating material, is bonded by a bonding material such as a glass frit 3. The cover 14 is drawn to bulge toward the second side of the cylindrical body 11.

The outer surface of the partition wall 12 on the first side is formed with a metalized conductive layer (a first and a second conductive layer) 15*a*, which ranges from a peripheral flat portion 12*a* to a central bulged portion 12*b*. On the second side, the partition wall 12 also has its outer surface formed with a conductive layer (a first conductive layer) over the peripheral flat portion 12*c* except for the notched portion 13. Likewise, the outer surface of the cover 14 is also formed with a similar conductive layer (a second conductive layer) 16. The conductive layer 15*a* of the partition wall 12 may be formed as two separate conductive layers—the conductive layer (first conductive layer) 15*a*′ over the peripheral flat portion 12*a* and the conductive layer (second conductive layer) 15*a*″ over the central bulged portion 12*b*—as long as these conductive layers 15*a*′ and 15*a*″ are electrically connected.

The bulged central portions of the partition wall 12 and the cover 14 are each formed with an opening 4*a*, 4*b*, respectively, in which electrodes 5 described later are installed. The opening 4*a* in the partition wall 12 is sealed with an electrode base 6*a* made of a metal plate while the second opening 4*b* in the cover 14 is sealed with an electrode base 6b. The electrode base 6a is fused to the conductive layer 15a of the bulged portion 12b of the partition wall 12 by a solder material 17. The electrode base 6b is fused to the conductive layer 15b of the partition wall 12 on the second side and to a part of the conductive layer 16 of the cover 14. If the conductive layer 15b on the second side of the partition wall 12 and the conductive layer 16 on the cover 14 are electrically interconnected by a certain means, the electrode base 6b need only be sealed at the conductive layer 15b on the partition wall 12.

Electrodes 5a, 5b, which are formed of such sputter prevention metals as tungsten and molybdenum with high melting points, are soldered to the inner surface of the electrode bases 6a, 6b fused to both sides of the partition wall 12. These electrodes 5a, 5b are installed in the openings 4a, 4b, respectively, with the front ends 5a', 5b' recessed from the inner surfaces 12d, 14a of the partition wall 12 and the cover 14 in a direction that they move away from each other. The electrodes 5a, 5b are each covered by the partition wall 12 and the cover 14.

One of the electrode bases 6b is formed with a gas supply hole 18 at a position such that the hole is not totally covered by the electrode 5b. On the outer surface the electrode base 6b is attached securely with a gas supply pipe 8 that communicates with the gas supply hole 18.

Figure 4:
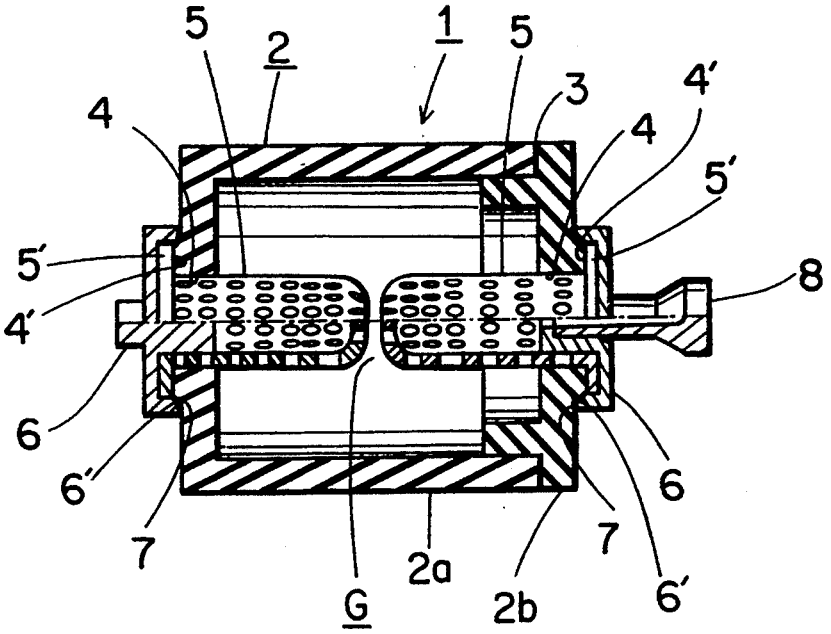
FIG. 4 PRIOR ART
FIG. 4 is a cross section of a conventional discharge tube.
Figure 5:
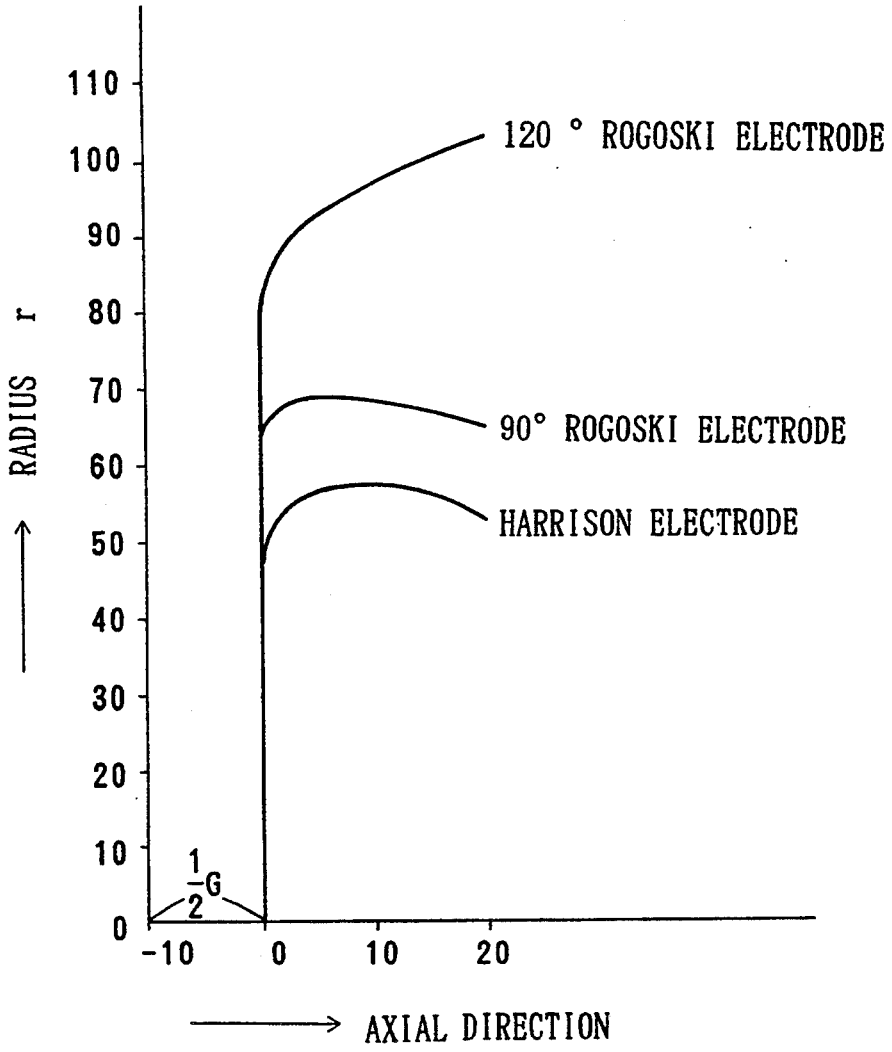
FIG. 5 PRIOR ART
FIG. 5 is a diagram showing the relationship between the discharge gap and the diameters of various types of uniform electric field generating electrodes.

In the discharge tube 1 of this invention, the partition wall 12 and the cover 14 function as the insulating tube 2 of the conventional discharge tube (FIG. 4). That is, the partition wall 12 works as a body portion 2a of the insulating tube 2 and the cover 14 as the cover portion 2b of the insulating tube 2. The space defined by the partition wall 12 and the cover 14 constitutes the discharge space S formed around the discharge gap G between the electrodes 5a, 5b opposingly disposed in the partition wall 12 and the cover 14. The bulged portions of the partition wall 12 and the cover 14 correspond to the drawn end portions of the conventional insulating tube 2. Further, the electrode bases G and the electrodes 5 secured to them constitute the discharge electrodes soldered to the ends of the insulating tube 2. A high pressure of discharge gas is admitted into the discharge tube through the gas supply pipe 8 and the hole 18.

In this embodiment therefore, the electrodes 5a, 5b do not project into the discharge space S formed by the partition wall 12 and the cover 14 but are enclosed by the partition wall 12 and the cover 14, respectively, so that the electrodes 5a, 5b can be protected against influences from electric fields from outside the discharge tube 1, thus ensuring stable discharges.

In this embodiment, when a voltage is applied between the electrode bases 6a and 6b, a potential difference occurs between the opposing conductive layers 15a (15a') and 15b formed over the peripheral flat portions on both sides of the partition wall 12, generating a nearly uniform electric field in the partition wall 12 between the conductive layers 15a (15a') and 15b. Also between the conductive layers 15a (15a'') and 16, which are formed facing each other on the bulged portion 12b of the partition wall 12 and the cover 14, a potential difference occurs. Therefore, as long as the conductive layers 15a (15a'') and 16 covering at least an area corresponding to the discharge space S are formed parallel to each other, the electric field generated in the discharge space S is nearly uniform.

With the uniform electric fields generated in the peripheral flat portion of the partition wall 12 and in the discharge space S cooperating with each other, the discharge tube 1 can have a wide region of uniform electric field. In this discharge tube, it is therefore possible to provide stable discharges in the discharge gap G between the opposing electrodes 5a and 5b without having to form the electrodes into those shapes of Rogoski and Harrison electrodes—electrodes that produce uniform electric fields but are difficult to manufacture. That is, stable discharges can be produced without forming the front ends of the electrodes into shapes with specially curved contours. For example, the cross section of the front end portion of the electrode may be chamfered into a quadrant arc to ensure stable discharges.

As mentioned above, since the opening 4b in the cover 14 is sealed by the electrode base 6b that is fused mostly to the partition wall 12 and not to the cover 14, the pressure of the high-pressure discharge gas contained in the discharge tube 1 practically does not act on the cover 14 but instead on the electrode base 6b. This greatly reduces the possibility of the joint between the cover 14 and the partition wall 12 being broken by the discharge gas pressure. That is, there is no danger that the bonded portion between the partition wall 12 which acts as the body portion of the insulating tube and the cover 14 which acts as the cover portion of the insulating tube may break under pressure causing a gas leakage. This prevents possible deterioration of the discharge characteristics due to gas leakage and assures stable and reliable discharges in the discharge tube.

Further, by using sputter prevention materials in forming the electrodes 5a, 5b, as described above, sputtering of one electrode 5a or 5b that works as a cathode can be prevented. The electrodes 5a, 5b, whose front ends have no such specially curved contours as those of uniform field generating electrodes, need only be chamfered at the front end corners to prevent the electric field from locally concentrating at the corners and thereby eliminate large variations in the discharge starting voltage.

The cylindrical body 11 functions as a cylinder that prevents external flashovers along the outer surface of the discharge tube 1, thereby assuring stable discharges.

Figure 2:
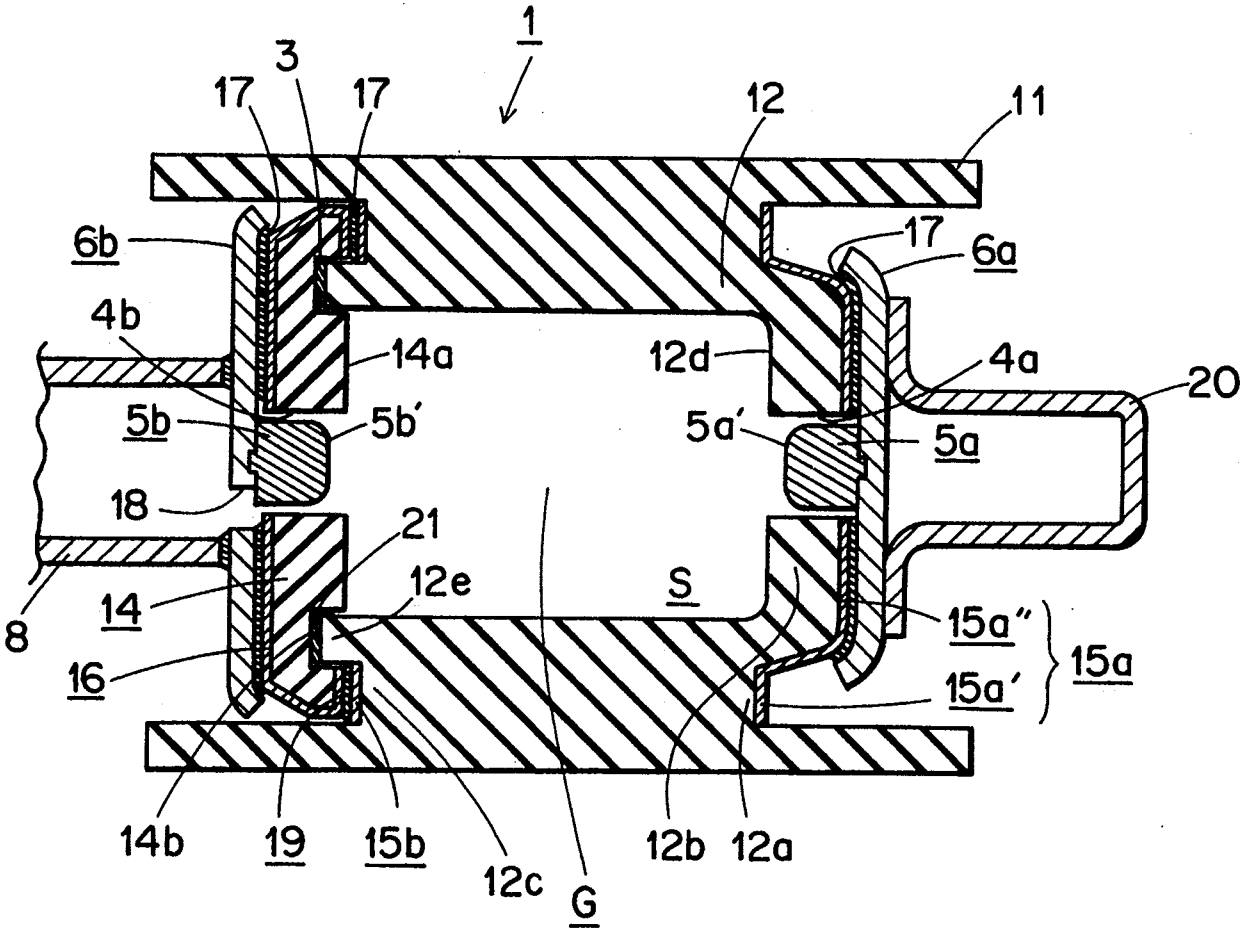
FIG. 2 is a cross section of a second embodiment of the discharge tube according to the invention.

FIG. 2 shows the second embodiment of the discharge tube 1 according to this invention. The cover 14 secured to the second side of the partition wall 12 is formed almost flat, instead of being drawn and swelled toward the second side of the cylindrical body 11. On the second side, the partition wall 12 is formed with an engagement projection 12e at the inner circumferential portion thereof that projects in the axial direction of the cylindrical body 11. The flat cover 14 is formed with an engagement recess 14b at its engagement surface that receives the engagement projection 12e. On the second side, the partition wall 12 has its peripheral flat portion 12c, excluding the engagement projection 12e, formed with a metalized conductive layer (first conductive layer) 15b. A similar conductive layer (second conductive layer) 16 is also formed over the outer surface of the cover 14. On the engagement surface, the cover 14 is also formed with a conductive layer (third conductive layer) 19 that is electrically connected with the second conductive layer 16.

With the engagement projection 12e of the partition wall 12 and the engagement recess 14b of the cover 14 fitted together, the conductive layer 15b of the partition wall 12 and the conductive layer 19 of the cover 14 are fused together by solder material 17. At the same time, a bonding material such as the glass frit 3 is filled between the engagement projection 12*e* and the engagement recess 14*b* to securely join the partition wall 12 and the cover 14 together.

In this embodiment, the conductive layer 15*b* of the partition wall 12 and the conductive layer 19 of the cover 14 are soldered together, making the joint between the partition wall 12 and the cover 14 very strong. Therefore, unlike the first embodiment, the electrode base 6*b* on the side of the cover 14 is not secured to the partition wall 12 but is directly fused to the conductive layer 16 of the cover 14.

Designated 20 is an external connection electrode. Other constructions are similar to the first embodiment. For example, the front end surfaces 5*a*', 5*b*', of the electrodes 5*a*, 5*b* installed in the openings 4*a*, 4*b* respectively of the partition wall 12 and the cover 14 are recessed from the inner end surfaces 12*d*, 14*a* of the partition wall 12 and the cover 14 in a direction that they move away from each other. Another similar point is that the electrodes 5*a*, 5*b* are enclosed by the partition wall 12 and the cover 14, respectively.

In this embodiment also, since the electrodes 5*a*, 5*b* are enclosed by the partition wall 12 and the cover 14, respectively, they are protected against influences from external electric fields from outside the discharge tube 1, thus providing stable discharges between the electrodes.

Because the uniform electric fields generated by the peripheral flat portions of the partition wall 12 and by the bulged portion 12*b* of the partition wall and the cover 14 cooperate with each other, the area of the uniform electric field in the discharge tube 1 is large, allowing stable discharges in the discharge gap G.

Since, with the engagement projection 12*e* of the partition wall 12 and the engagement recess 14*b* of the cover 14 fitted together, the conductive layer 15*b* of the partition wall 12 and the conductive layer 19 of the cover 14 are soldered together, the partition wall 12 and the cover 14 are joined very strongly, eliminating the possibility of gas leakage and providing a highly reliable discharge tube 1. The engagement between the engagement projection 12*e* and the engagement recess 14*b* forms a small gap 21, which in turn elongates the internal surface flashover distance of the discharge tube 1, reducing the chances of internal flashover and assuring stable discharges. If the bonding material is not filled into the gap 21, as it is in the above embodiment, the similar effect can be obtained in terms of preventing the internal flashover.

Since the cover 14 is formed nearly flat, the ease of machining when it is formed of such insulating materials as alumina ceramics improves and at the same time the machining precision can also be enhanced. This permits the partition wall 12 and the cover 14 to be assembled with high precision, mating this discharge tube construction suited for mass production.

Figure 3:
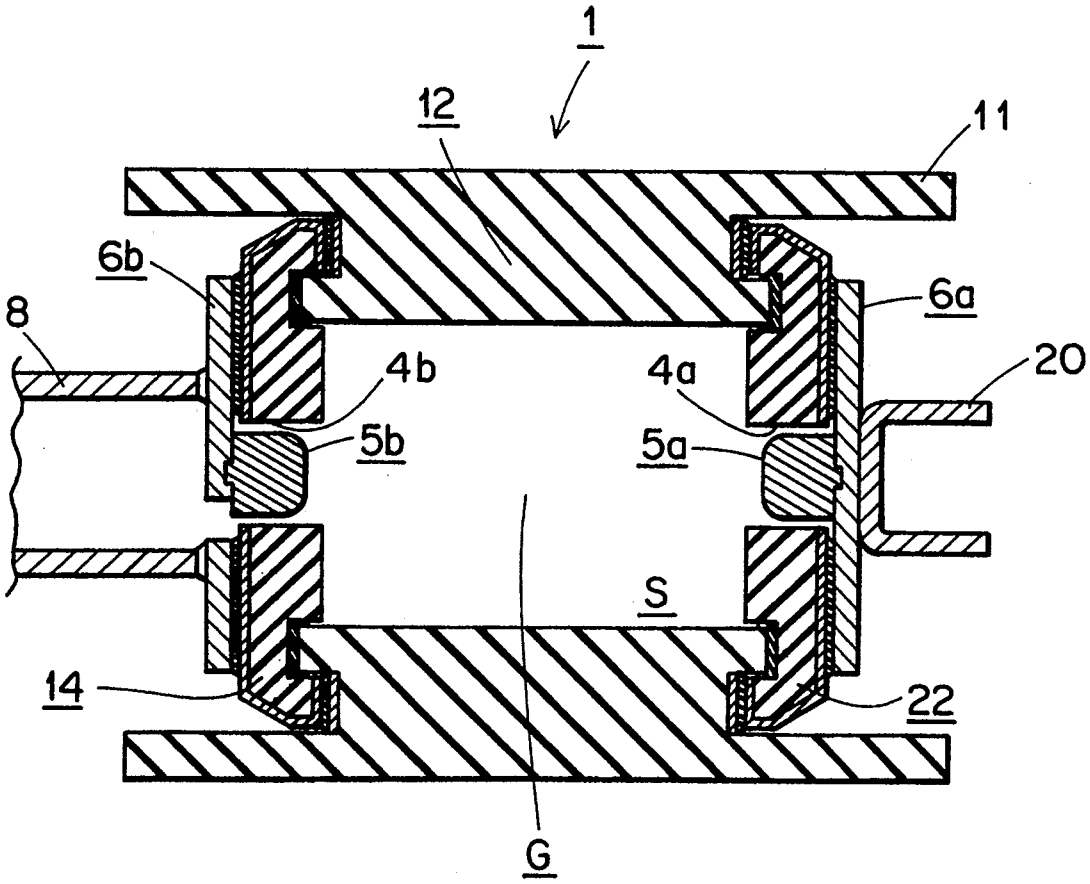
FIG. 3 is a cross section of a third embodiment of the discharge tube according to the invention.

FIG. 3 shows the third embodiment of the discharge tube 1 according to this invention. On both sides of the partition wall 12 of the cylindrical body 11, both of the inwardly drawn portions are formed by flat covers 22, 14, which are fitted and joined to both sides of the partition wall 12. In other respects the construction is similar to the second embodiment.

In this embodiment also, the similar effects to the second embodiment can be obtained. The use of flat covers 22, 14 enhances the suitability for mass production.

The advantages of this invention may be summarized as follows.

Since the discharge electrodes are disposed in the inwardly drawn portions of the cylindrical body in such a way that the front ends of the electrodes are recessed from the inner surfaces of the drawn portions, which face the other discharge electrodes, in a direction that they move away from each other, the discharge electrodes do not project into the internal space inside the cylindrical body but are enclosed by the inwardly drawn portions. This construction prevents the electrodes from being affected by external electric fields from outside the discharge tube, thus assuring stable discharges.

Another advantage is that the first electric field generated in the inwardly drawn portions of the cylindrical body that enclose the discharge electrodes and the second electric field generated in the body portion of the cylindrical body by the potentials applied to the discharge electrodes cooperate with each other to produce a combined electric field near the tips of the discharge electrodes. The electric field thus produced near the tips of the electrodes is more uniform than when the electrodes are not enclosed by the inwardly drawn portions. As a result, the discharges become more stabilized.

Further, the inwardly drawn portions of the cylindrical body are formed by the covers; the body portion of the cylindrical body is provided with the first conductive layers; the outer surfaces of the covers are provided with the second conductive layers; and the joint surfaces of the covers with respect to the body portion are provided with the third conductive layers which are electrically connected with the second conductive layers. The first and third conductive layers are soldered together to firmly join the body portion and the cover portion, providing a highly reliable discharge tube with no possibility of gas leakage. This construction improves the precision with which to assemble the cylindrical body and also enhances the mass-productivity.

Furthermore, since on that side of the body portion to which the cover portion is joined, the discharge electrode is not soldered to the cover portion but is soldered to the body portion of the cylindrical body, the high gas pressure acting on the discharge electrode, which forms the gas sealing portion, does not directly act on the cover portion, preventing a possible break of the joint between the body portion and the cover portion caused by high gas pressure. As a result, the discharge tube has high reliability and desired performance without a possibility of gas leakage.

What is claimed is:

1. A discharge tube comprising:

a cylindrical body made of an insulating material in which a discharge gas is sealed, the cylindrical body having a body portion and an inwardly drawn portion, said body portion having at least two ends thereof, the inwardly drawn portion being inwardly drawn from at least one of the at least two ends of the body portion; and a pair of opposing discharge electrodes located inside and at each of said at least two ends of the body portion, one of the discharge electrodes being disposed inside the inwardly drawn portion so that said one discharge electrode is enclosed by the inwardly drawn portion and that a front end portion of the one discharge electrode is recessed from an inner end surface of the inwardly drawn portion facing the other discharge electrode of said pair of discharge electrodes, said one electrode being recessed in a direction away from the other electrode.

2. A discharge tube according to claim 1, wherein the body portion of the cylindrical body is provided with a first conductive layer, an outer surface of the inwardly drawn portion is provided with a second conductive layer which is electrically connected with the first conductive layer, and the first and the second conductive layers are applied with a potential of the one discharge electrode.

3. A discharge tube according to claim 1, wherein the cylindrical body is formed of the body portion and a cover portion, the cover portion is formed as the inwardly drawn portion, the body portion is provided with a first conductive layer, an outer surface of the cover portion is provided with a second conductive layer, a joint surface of the cover portion with respect to the body portion is provided with a third conductive layer electrically connected with the second conductive layer, the first and the third conductive layers are fused together, and wherein each of these conductive layers is applied with a potential of the one discharge electrode.

4. A discharge tube comprising:

a cylindrical body made of an insulating material in which a discharge gas is sealed, the cylindrical body having a body portion and a cover portion joined together, the cylindrical body having end portions thereof drawn inwardly;

a pair of opposing discharge electrodes located inside the inwardly drawn portions;

first opposing conductive layers provided to the body portion of the cylindrical body; and second opposing conductive layers provided to outer surfaces of the inwardly drawn portions of the cylindrical body, the second conductive layers being electrically connected with the first conductive layers;

whereby the first conductive layers and the second conductive layers are applied with potentials of the corresponding discharge electrodes, respectively, and at least one of the first conductive layers on that side of the body portion where the cover portion is joined is fused with one of the discharge electrodes located on the cover portion side.

5. A discharge tube comprising:

a cylindrical body made of an insulating material in which a discharge gas is sealed, the cylindrical body having a body portion and at least one cover portion joined together, the cylindrical body having end portions thereof drawn inwardly;

a pair of opposing discharge electrodes located inside the inwardly drawn portions;

first opposing conductive layers provided to the body portion of the cylindrical body;

second opposing conductive layers provided to outer surfaces of the inwardly drawn portions of the cylindrical body; and a third conductive layer provided to a joint surface of the cover portion joined with the body portion, the cover portion constituting at least one of the inwardly drawn portions, the third conductive layer being electrically connected with the second conductive layer;

whereby one of the first conductive layers and the third conductive layer are fused together and all three types of conductive layers are applied with potentials of the corresponding discharge electrodes, respectively.

6. A discharge tube according to claim 3, wherein at a joint portion between the body portion and the cover portion, one of the body portion and the cover portion is formed with an engagement projection and the other is formed with an engagement recess.

7. A discharge tube according to claim 1 wherein the discharge electrodes are formed by electrodes that generate discharges and electrode bases that hold the electrodes, one of the electrode bases is formed with a gas supply hole and provided with a gas supply pipe that communicates with the gas supply hole, and one of the electrodes is located at a position such that the electrode does not cover the whole of the gas supply hole.

8. A discharge tube according to claim 1 wherein the electrodes of the discharge electrodes that generate discharges are made of a high-melting point metal.

* * * * *